US009173506B2

(12) United States Patent
Andersson et al.

(10) Patent No.: US 9,173,506 B2
(45) Date of Patent: Nov. 3, 2015

(54) WALL MOUNTED STORING CONSTRUCTIONS

(75) Inventors: Benny Andersson, Almhult (SE); Lars Almblad, Almhult (SE); Mats Lundqvist, Lonsboda (SE); Sofia Wiktorsson, Malmo (SE)

(73) Assignee: Inter IKEA Systems B.V., Delft (NL)

( * ) Notice: Subject to any disclaimer, the term of this patent is extended or adjusted under 35 U.S.C. 154(b) by 0 days.

(21) Appl. No.: 14/358,904

(22) PCT Filed: Nov. 18, 2011

(86) PCT No.: PCT/EP2011/070421
§ 371 (c)(1),
(2), (4) Date: Oct. 14, 2014

(87) PCT Pub. No.: WO2013/071977
PCT Pub. Date: May 23, 2013

(65) Prior Publication Data
US 2015/0027972 A1 Jan. 29, 2015

(51) Int. Cl.
*A47B 43/00* (2006.01)
*A47F 5/08* (2006.01)
(Continued)

(52) U.S. Cl.
CPC ..... *A47F 5/0807* (2013.01); *A47B 47/0058* (2013.01); *A47B 57/42* (2013.01);
(Continued)

(58) Field of Classification Search
CPC .... A47B 57/42; A47B 57/485; A47B 96/061; A47B 96/1408; A47B 47/0058; A47B 2230/07; A47F 5/0807
USPC ..... 211/90.01, 90.02, 186, 187; 108/106–108, 147.17; 248/220.21, 248/220.31, 225.21, 235, 250
See application file for complete search history.

(56) References Cited

U.S. PATENT DOCUMENTS 392,061 A * 10/1888 Peckham ..... 108/147.17
2,191,701 A * 2/1940 Wood ..... 248/245
(Continued)

FOREIGN PATENT DOCUMENTS

EP 0 527 658 2/1993
FR 2 319 282 2/1977
(Continued)

OTHER PUBLICATIONS

International Search Report for International Application No. PCT/EP2011/070421 mailed Oct. 31, 2012 (3 pages).

*Primary Examiner* — Joshua J Michener
*Assistant Examiner* — Devin Barnett
(74) *Attorney, Agent, or Firm* — Merchant & Gould P.C.

(57) ABSTRACT

The present invention concerns a wall mounted storing construction or system that could hold a number of storing means. The storing means used may be shelves, hangers for different clothes, such as trousers or coats, shoe holders, rods etc. or for different combinations of these storing means. The storing system comprises uprights (1) and brackets (3), wherein the brackets (3) are mounted in the uprights (1). The brackets (3) are to receive the storing means, such as shelves (15). Each bracket (3) has a general u-from with an upper part and two walls, having ears (10) to be received in openings (22) of the uprights (1). The walls of brackets (3) are pressed together in the area of the ears (10) to allow the ears (10) of the brackets (3) to be pushed into the uprights (1). The uprights (1) are fixed to the wall. The upper end of each upright (1) is mounted on a horizontal assembly rail (2), being fixed to the wall. Each upright (1) is attached to the assembly rail (2) in a way making it possible to slide the uprights (1) along the assembly rail.

9 Claims, 5 Drawing Sheets

(51) Int. Cl.

| | |
|---|---|
| ***A47B 57/42*** | (2006.01) |
| ***A47B 57/48*** | (2006.01) |
| ***A47B 96/06*** | (2006.01) |
| ***A47B 96/14*** | (2006.01) |
| ***A47B 47/00*** | (2006.01) |
| *A47B 57/06* | (2006.01) |

(52) U.S. Cl.

CPC ..... *A47B 57/485* (2013.01); *A47B 96/061* (2013.01); *A47B 96/1408* (2013.01); *A47B 57/06* (2013.01); *A47B 2230/07* (2013.01)

(56) References Cited

U.S. PATENT DOCUMENTS

| | | | | | |
|---|---|---|---|---|---|
| 3,136,520 | A | * | 6/1964 | Reiss | 248/243 |
| 3,203,375 | A | | 8/1965 | Schroeder | |
| 3,220,363 | A | * | 11/1965 | Gingher | 108/147.17 |
| 3,439,812 | A | * | 4/1969 | Nagelkirk Preston et al. | 211/90.04 |
| 3,602,374 | A | * | 8/1971 | Alabaster | 211/193 |
| 3,664,627 | A | * | 5/1972 | Sykes | 248/246 |
| 4,103,855 | A | * | 8/1978 | Grosse | 248/246 |
| 4,223,863 | A | * | 9/1980 | Birman | 248/246 |
| 4,373,694 | A | * | 2/1983 | Peterson | 248/246 |
| 4,660,477 | A | * | 4/1987 | Kortering et al. | 108/108 |
| 4,869,451 | A | * | 9/1989 | Gordon | 248/235 |
| 5,054,404 | A | * | 10/1991 | Melgers | 108/108 |
| 5,272,991 | A | * | 12/1993 | Carrigan, Jr. | 108/108 |
| 5,297,486 | A | * | 3/1994 | Herrmann et al. | 108/108 |
| 5,364,052 | A | * | 11/1994 | De Gruttis | 248/245 |
| 5,405,114 | A | * | 4/1995 | Dias | 248/250 |
| 5,538,213 | A | * | 7/1996 | Brown | 248/222.11 |
| 5,592,886 | A | * | 1/1997 | Williams et al. | 108/108 |
| 5,813,741 | A | * | 9/1998 | Fish et al. | 312/408 |
| 6,019,331 | A | * | 2/2000 | Hoogland et al. | 248/250 |
| 6,189,707 | B1 | * | 2/2001 | Meyers et al. | 211/90.04 |
| 6,220,463 | B1 | * | 4/2001 | Pullen | 211/186 |
| 6,345,579 | B1 | * | 2/2002 | Zaturensky | 108/152 |
| 6,378,712 | B1 | * | 4/2002 | Sampl | 211/186 |
| 6,691,964 | B1 | * | 2/2004 | Schaefer | 248/250 |
| 6,978,975 | B1 | * | 12/2005 | Magnusson | 248/249 |
| 7,296,697 | B2 | * | 11/2007 | Costa et al. | 211/175 |
| 7,300,122 | B2 | * | 11/2007 | Vardon | 312/408 |
| 7,311,211 | B2 | * | 12/2007 | Chung | 211/90.02 |
| 2003/0233965 | A1 | * | 12/2003 | Brazier | 108/108 |
| 2003/0234231 | A1 | * | 12/2003 | Rowe | 211/90.02 |
| 2005/0045787 | A1 | * | 3/2005 | Magnusson | 248/235 |
| 2006/0175495 | A1 | * | 8/2006 | Gregory | 248/250 |
| 2006/0213849 | A1 | * | 9/2006 | Bienick | 211/90.02 |
| 2007/0221597 | A1 | * | 9/2007 | Chen | 211/192 |
| 2007/0241072 | A1 | * | 10/2007 | Bryant et al. | 211/90.02 |
| 2008/0272076 | A1 | * | 11/2008 | Davenport | 211/90.01 |
| 2010/0213334 | A1 | | 8/2010 | Davenport | |
| 2010/0258692 | A1 | * | 10/2010 | Kluge | 248/250 |
| 2012/0062092 | A1 | * | 3/2012 | Jung et al. | 312/405 |

FOREIGN PATENT DOCUMENTS

| | | |
|---|---|---|
| GB | 2 071 484 | 9/1981 |
| WO | WO 95/29613 | 11/1995 |
| WO | WO 2004/000073 | 12/2003 |

* cited by examiner

WALL MOUNTED STORING CONSTRUCTIONS

This application is a National Stage Application of PCT/EP2011/070421, filed 18 Nov. 2011 and which application is incorporated herein by reference. To the extent appropriate, a claim of priority is made to the above disclosed application.

TECHNICAL FIELD

The present invention concerns a wall mounted storing construction or storing system that could hold a number of storing means. The storing means used may be shelves, hangers for different clothes, such as trousers or coats, shoe holders, rods etc. or a combination of different storing means.

BACKGROUND

Storing systems are known in many different forms and for the storing of many different products. Normally the storing systems have at least some kind of shelves, but they have often also other types of storing means. Some storing systems are free-standing, while others are to be mounted directly on a wall or the like. The storing system of the present invention is directed to systems to be mounted on a wall.

For storing systems to be mounted on walls it is beneficial if a straight mounting is facilitated.

SUMMARY

In many cases there is a desire to have a storing means that is flexible in that it can be used for storing different objects. It is also desirable that it is relatively easy to make changes regarding of what is to be stored. It should also be possible to build on new parts if needed. Still a further desire is that it should be relatively easy to mount and dismount shelves, holders for different clothes etc. The storing means should also be held securely in the storing system.

According to one aspect of the present invention a number of vertical uprights are fixed to a wall. Brackets to receive any storing means are pushed into the uprights. The brackets are to project from the uprights. Ears at one end of the brackets are received in openings of the uprights. The insertion of the brackets in the uprights is accomplished by pressing each bracket together by hand in the region of the ears. When the brackets have been inserted the pressure on the brackets will be released, whereby the ears will flex out and be locked in the openings of the uprights.

In a further aspect of the invention the uprights are mounted on a horizontal assembly rail, being fixed to the wall. The upper end of each upright is attached to the assembly rail by means of an assembly unit in a way making it possible to slide the uprights along the assembly rail. By means of the connection between the uprights and the assembly rail correct mounting of the total storing system is facilitated.

Further objects and advantages of the present invention will be come apparent to a person skilled in the art when reading the detailed description below of different embodiments.

BRIEF DESCRIPTION OF THE DRAWINGS

The invention will be explained further below by way of examples and with reference to the enclosed drawings. In the drawings.

DETAILED DESCRIPTION

Figure 1:
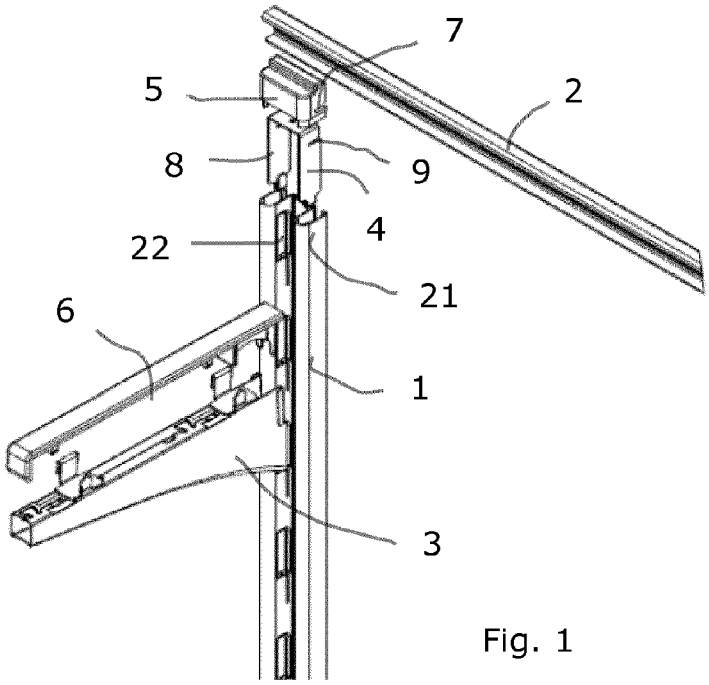
FIG. 1 is an exploded view of major parts of a storing construction according to the present invention.
Figure 2:
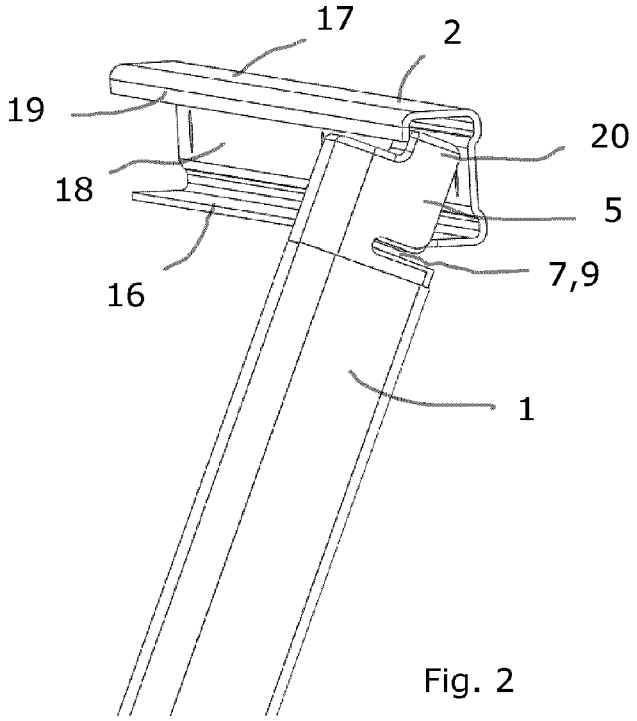
FIG. 2 is a detailed view illustrating connection between an assembly rail and an upright according to the present invention.
Figure 3:
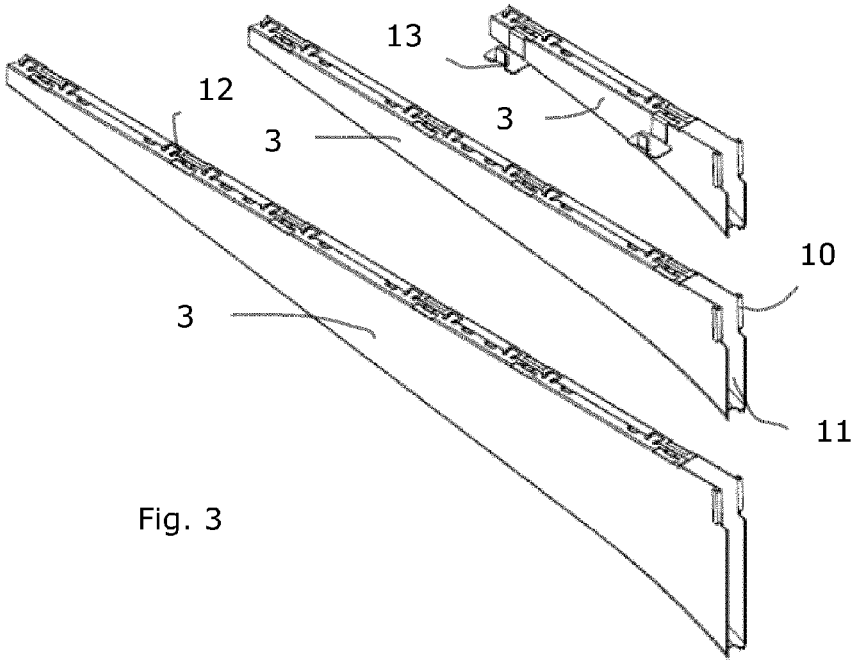
FIG. 3 is a perspective view of brackets according to the invention, illustrating different sizes of the brackets.
Figure 4:
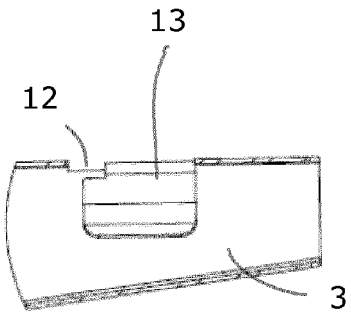
FIG. 4 is a cross section view of a part of a bracket with a shelf holder attached.

As used in this description the terms "vertical", "horizontal" and similar expressions are in view of the Figs. referred to and in view of a normal placing of a storing system.

The construction of the invention comprises a number of uprights 1, to be placed with a vertical extension. The uprights 1 are placed hanging in an assembly rail 2. The assembly rail 2 is fixed to a wall with a horizontal extension. The uprights 1 are placed in the assembly rail 2 by means of a lower assembly part 4 and an upper assembly part 5, which lower and upper assembly parts 4, 5 are placed as one unit at an upper part of each upright 1. The function of the assembly parts 4, 5 will be described further below.

Brackets 3 are placed in each upright 1. The number of brackets 3 and their placement and form varies depending on the intended use. Covers 6 are placed on top of the brackets 3 and are partly used to lock parts received on the brackets 3 in a way to be explained further below.

The assembly rail 2 has a general u-form in cross section, with a wall part 18 to be placed against the wall. A lower flange 16 and an upper flange 17 project away from the wall part 18 of the assembly rail 2. The lower flange 16 of the assembly rail 2 has a general plate form, and the upper flange 17 has a plate part going over in a front part 19 directed downwards. The assembly rail 2 is fixed to the wall by means of screws or other fastening means going through the wall part 18 of the assembly rail 2. Normally a number of openings are provided for the fastening means in the wall part 18 of the assembly rail 2.

Each upright 1 has a general u-form in cross section, with a back part to be placed against the wall and two channels 21 on each side of the back part, which channels 21 projects forward. A number of openings 22 are placed on the sides of the channels 21 facing each other. The openings 22 are used to receive the brackets 3. The lower assembly part 4 has two legs 8 which are received in the channels 21 of each upright 1. The legs 8 of the lower assembly part 4 will be fixed to the uppermost openings 22 of the channels 21 of the upright 1. The legs 8 have projecting parts that will go into the openings 22. The lower assembly part 4 will extend a short distance above the upright 1 in mounted condition. In use the upper assembly part 5 is placed outside the lower assembly part 4 and outside the channels 21 of each upright 1. The lower assembly part 4 has a slit 9 for co-operation with the lower flange 16 of the assembly rail 2. The upper assembly part 5 also has a slit 7. The slit 9 of the lower assembly part 4 is placed flush with the slit 7 of the upper assembly part 5 when the upper assembly part 5 has been placed outside the channels 21 of the upright 1. The upper assembly part 5 has a narrow end part 20. When the uprights 1 are to be mounted to the assembly rail 2, the unit formed by the lower and upper assembly parts 4, 5 is placed at the upper end of each upright 1. The narrow end part 20 of the upper assembly part 5 is placed between the wall part 18 and the front part 19 of the upper flange 17 of the assembly rail 2. The upright 1 is then turned towards the wall, whereby the lower flange 16 of the assembly rail 2 will go into the slits 7, 9 of the upper assembly part 5 and the lower assembly part 4, respectively. As stated above the slits 7, 9 of the upper assembly part 5 and the lower assembly part, respectively, are placed flush with each other in assembled condition. After placement on the assembly rail 2 each upright 1 may be slid along the assembly rail to a position depending on the parts to be received on the brackets 3. The uprights 1 are then fixed to the wall by means of fastening means, such as screws, going through the back part of each upright 1. Normally a number of openings are provided in the back of each upright 1 to receive the fastening means. The connection between the uprights 1 and the assembly rail 2 facilitates proper positioning of the storing system.

The brackets 3 have a general u-form with an upper part and an open space 11 between two vertical walls. The brackets 3 have ears 10 at a rear end, which rear end is to be received in the uprights 1. The ears 10 are to be received in the openings 22 in the channels 21 of the uprights 1. At a distance in front of the ears 10 there is no upper part. One purpose of not having any upper part in the region of the ears 10 is that it should be possible to press the walls of the bracket 3 towards each other. To place a bracket 3 in an upright 1 the walls of the bracket 3 are pressed against each other in the region of the ears 11, whereby the ears 10 of the bracket 3 will be moved toward each other and the bracket 3 may be pushed into the upright 3. There after the walls are released, whereby the ears 11 of the bracket 3 will flex outwards and will be placed in the openings 22 of the upright 1. The parts of the bracket 3 placed below the ears 10, and projecting backwards, will abut the back of the upright 3. The brackets 3 have a number of openings 12 for receiving holders 13, which holders 13 are adapted to the storing means to be received on the brackets 3. The part of each holder 13 to be inserted in an opening of the bracket 3 has a lower part with a vertical end directed backwards, toward the wall, which vertical end projects somewhat backwards in relation to the part of the holder 13 placed at the upper edge of the opening 12. In the shown embodiment the holders 13 are for shelves 15.

Figure 5:
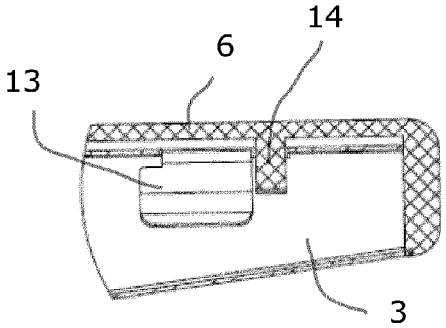
FIG. 5 is a cross section view corresponding with FIG. 4 but with a cover also attached.
Figure 6A:
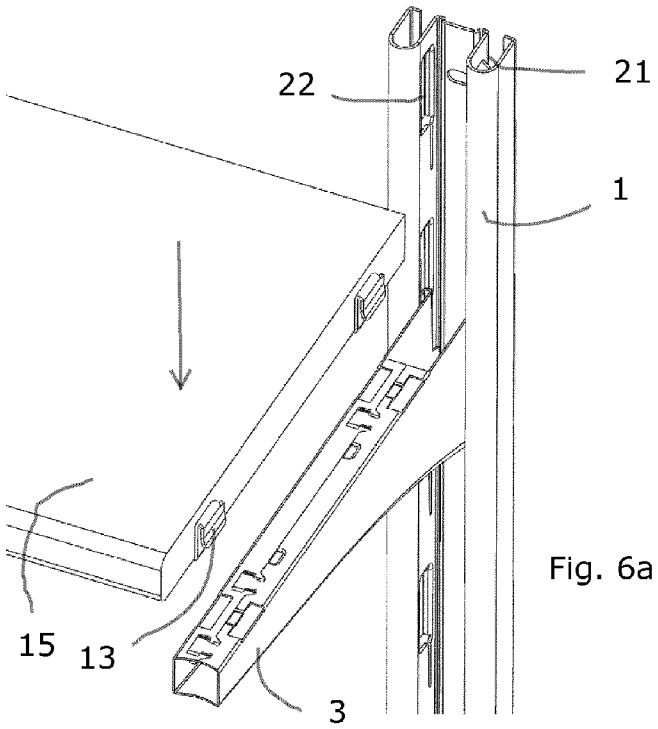
FIGS. 6*a* to 6*d* are perspective views illustrating mounting of a shelf according to the invention.
Figure 6B:
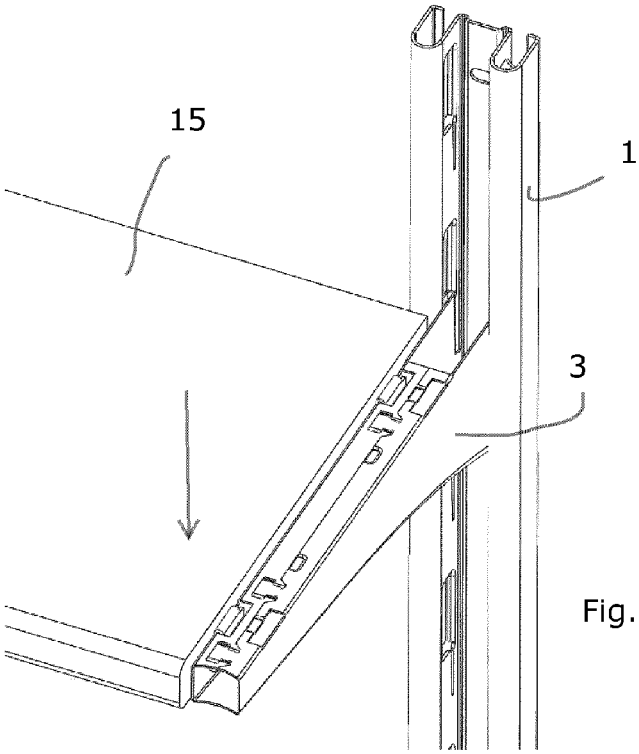
Figure 6C:
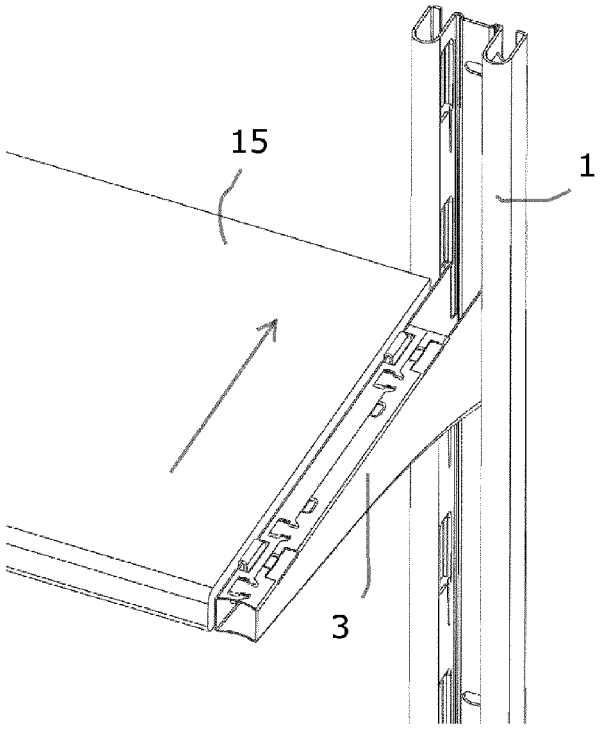
Figure 6D:
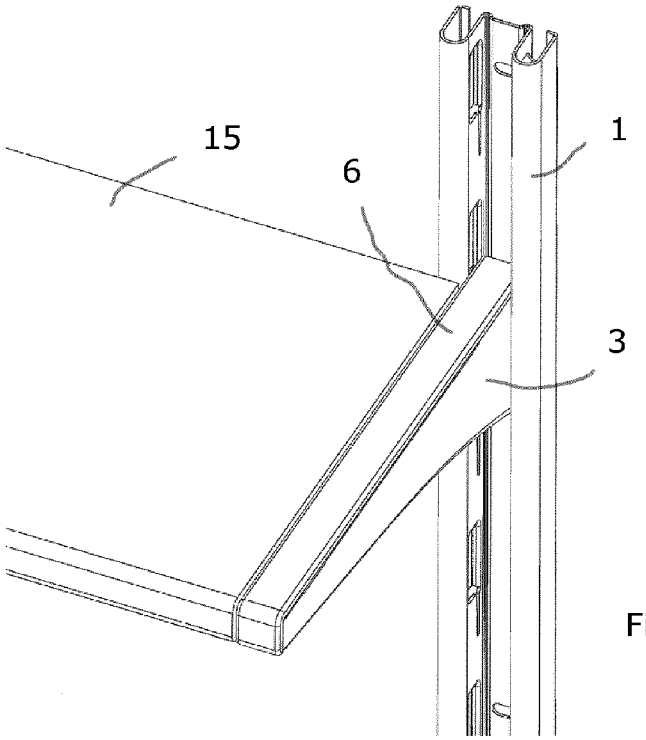

In FIGS. 6*a* to 6*d* mounting of a shelf 15 is shown schematically. First the holders 13 of the shelf 15 are placed in the openings 12 of the bracket as indicated by the arrow in FIGS. 6*a* and 6*b*, respectively. The shelf 15 is then pushed backwards towards the wall, as indicated by the arrow of FIG. 6*c*. When the shelf 15 is pushed backwards each holder 13 will be moved backwards in respective opening 12 of each bracket 3, whereby the projecting part of the holder 13 will be placed below a horizontal part of the bracket 3. With the shelf 15 in the position pushed backwards a cover 6 is placed on top of each bracket 3, as indicated in FIG. 6*d*. The cover 6 has a number of pins 14 projecting downwards, whereby one pin 14 is arranged to be received in each opening 12 of the bracket 3. In openings 12 receiving a holder 13, the pin 14 of the cover 6 will be placed between the holder 13 and the end of the opening 12 locking the holder 13, as indicated in FIG. 5. Thus, the locking of the holder 13 is accomplished by cooperation between the projecting part of the holder 13, the opening 12 of the bracket 3 and the pin 14 of the cover 6.

Figure 7:
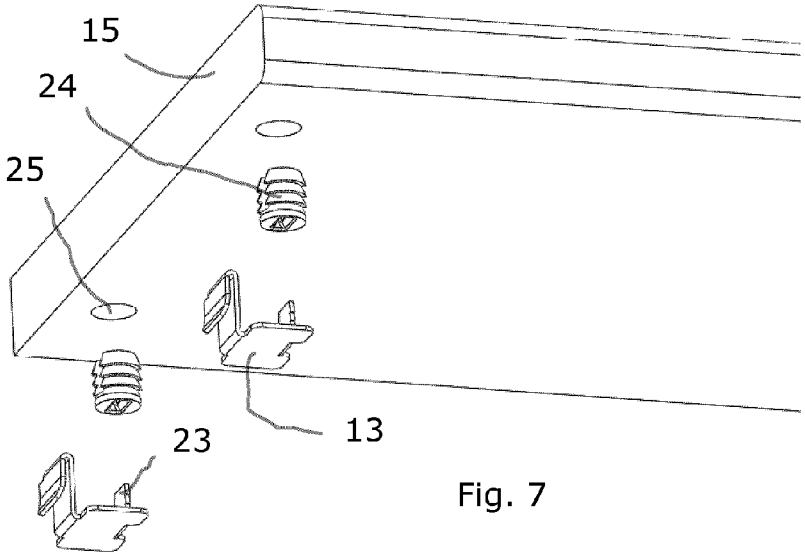
FIG. 7 is an exploded view illustrating one example of mounting means for a shelf.

In FIG. 7 one example of attaching holders 13 to a shelf 15 is indicated. The shelf 15 has a number of openings 25 on a lower side. Each holder 13 has an outer flange 23 opposite the part of the holder 13 to be received in an opening 12 of a bracket 3. The flange 23 is to be inserted in an opening at a lower end of a dowel 24, which dowel 24 is to be placed in one of the openings 25 of the shelf 15.

Figure 8:
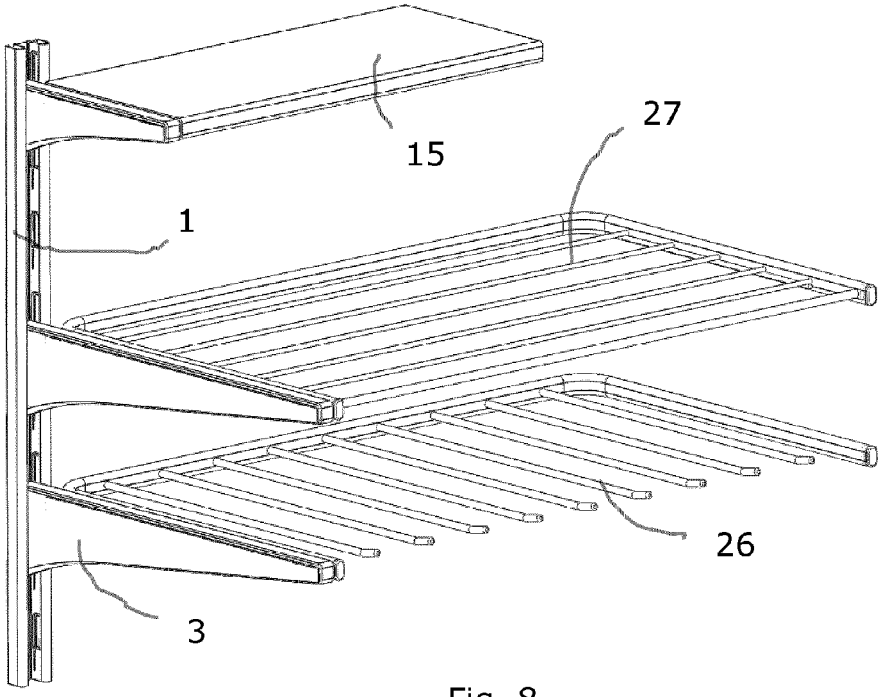
FIG. 8 is a perspective view illustrating some examples of storing means.

In FIG. 8 three examples of different storing means are shown, indicating one of the flexibilities of the present invention. In the example of FIG. 8 a shelf 15 is placed at the top, which shelf is used with shorter brackets than the other shown storing means. The two lower storing means are different types of clothes hangers 26, 27.

The invention claimed is:

1. A wall mountable shelving system comprising uprights, brackets, at least one shelf having a plurality of holders each comprising a generally vertical male connector portion located to a side of the at least one shelf, and bracket covers each having downwardly extending pins, wherein the brackets are mountable in the respective uprights, wherein a pair of the brackets are configured to support the at least one shelf; wherein each bracket has two sidewalls, a top wall and a bottom wall that each extend between the two sidewalls, wherein the top wall comprises inner and outer female apertures, wherein the male connector portions of the at least one shelf are configured to be inserted in corresponding inner female apertures of respective brackets, and the pins of the covers are configured to be inserted in corresponding outer female apertures of respective brackets, wherein when assembled, the at least one shelf is attached to and rest upon respective brackets and a corresponding cover is attached to each respective bracket to conceal the top wall of the respective brackets and the male connector portions of the at least one shelf; wherein each upright has a back central part adapted to be fixed to a wall by fasteners and two generally U-shaped channels projecting forwardly at opposite sides of the back part, wherein a number of openings are placed on sides of the channels facing each other, each bracket has ears extending generally perpendicular from each side wall of the respective bracket, wherein the ears are configured to be received in corresponding openings of the uprights to attach the brackets to the uprights.

2. The wall mountable shelving system of claim 1, wherein there is no top wall in the area of the ears of each bracket.

3. The wall mountable shelving system of claim 1, wherein each upright part is mountable to an assembly rail at the upper end of each upright, wherein, when assembled, the assembly rail is perpendicular to the uprights.

4. The wall mountable shelving system of claim 3, wherein, when assembled, the uprights are mounted in a way admitting sliding along the assembly rail.

5. The wall mountable shelving system of claim 4, wherein an assembly unit is configured to be mounted to the upper part of each upright for mounting to the assembly rail, wherein the assembly unit comprises an upper assembly part and a lower assembly part, wherein the lower assembly part unit has two legs to be received in the channels of each upright and wherein the upper assembly part is to be placed outside the channels of the upright.

6. The wall mountable shelving system of claim 4, wherein the assembly rail has a general U-form with a back part to be attached to a wall and a lower flange and an upper flange projecting from opposite sides of the back part.

7. The wall mountable shelving system of claim 6, wherein the upper flange of the assembly rail has a front part directed downwards and wherein the lower flange has a general plate form.

8. The wall mountable shelving system of claim 7, wherein the upper assembly part has a narrow end part to be received behind the front part of the upper flange of the assembly rail and wherein the lower assembly part has a slit and the upper assembly part has a slit, wherein the slits are flush with each other when the upper assembly part is received on the lower assembly part, and the slits are configured to receive the lower flange of the assembly rail.

9. A method of attaching the at least one shelf to the wall mounted shelving system of claim 1, wherein the male connector portions of the at least one shelf are placed within the corresponding inner female apertures of respective brackets, wherein after the at least one shelf is pushed backwards towards the wall, the bracket covers are placed on top of the respective brackets with the at least one shelf pushed backward, whereby the pins of the covers lock the at least one shelf in place on the respective brackets.

* * * * *